United States Patent [19]

Basile

[11] Patent Number: 5,025,510

[45] Date of Patent: Jun. 25, 1991

[54] TOILET HAVING HYGIENIC CLEANING APPARATUS

[76] Inventor: Pauline R. Basile, 418 S. Valley Forge Rd., Devon, Pa. 19333

[21] Appl. No.: 455,576

[22] Filed: Jan. 30, 1990

Related U.S. Application Data

[63] Continuation of Ser. No. 266,568, Nov. 3, 1988, Pat. No. 4,924,534.

[51] Int. Cl.[5] ..... A47K 7/08

[52] U.S. Cl. ..... 4/447; 4/420.4; 248/309.4

[58] Field of Search ..... 4/443–448, 4/420.1–420.5, 232; 248/206.5, 309.4

[56] References Cited

U.S. PATENT DOCUMENTS

| | | | |
|---|---|---|---|
| 392,461 | 11/1888 | Reid | 4/444 |
| 1,187,759 | 6/1916 | Manahan | 4/420.2 |
| 1,835,497 | 12/1931 | Kahn | 4/420.5 |
| 1,990,578 | 2/1935 | Zorraquin | 4/420.5 |
| 2,104,271 | 1/1938 | Parisini | 4/448 |
| 2,600,619 | 6/1952 | Conterno | 4/448 X |
| 2,642,999 | 6/1953 | McPherson | 248/309.4 X |
| 2,702,683 | 2/1955 | Green et al. | 248/309.4 |
| 3,256,531 | 6/1966 | Arensberg | 4/448 |
| 3,781,919 | 1/1974 | Ayala | 4/447 |
| 3,979,781 | 9/1976 | Jolicoeur | 4/447 X |
| 4,041,553 | 8/1977 | Sussman | 4/447 |
| 4,242,764 | 1/1981 | Fukada | 4/420.4 |
| 4,550,454 | 11/1985 | Yui | 4/420.4 |
| 4,551,867 | 11/1985 | Gurevich et al. | 4/420.4 |
| 4,691,391 | 9/1987 | Kuo | 4/447 |

FOREIGN PATENT DOCUMENTS

| | | | |
|---|---|---|---|
| 0101387 | 2/1984 | European Pat. Off. | 4/420.4 |

*Primary Examiner*—Ernest G. Cusick
*Assistant Examiner*—Casey Jacyna
*Attorney, Agent, or Firm*—Woodcock Washburn Kurtz Mackiewicz & Norris

[57] ABSTRACT

Novel toilets and toilet seats having hygienic cleaning apparatus are provided which include valve-regulated water sources and flexible conduit means for transferring a flow of water to a point of application. The flexible conduit is disposed to be resiliently extendable from a position integral with the toilet or seat. Alternative embodiments include magnetically-attracting elements for attaching nozzles, connected to the flexible conduit, to either the toilet seat or bowl rim for keeping the nozzles out of sight when not in use. Further embodiments include a separate compartment for housing a portion of the flexible conduit and the nozzle. This compartment includes a lid which can be opened by the user when hygienic washing is required, and may further include a removable drainage seal.

5 Claims, 3 Drawing Sheets

TOILET HAVING HYGIENIC CLEANING APPARATUS

This is a division of application Ser. No. 07/266,568, filed Nov. 3, 1988, and now U.S. Pat. No. 4,924,534, May 15, 1990.

FIELD OF THE INVENTION

This invention relates to toilets and toilet seats having hygienic apparatus for applying a flow of water to a user, and more particularly to an inexpensive bidet apparatus adapted to be applied to a conventional toilet seat and bowl configuration.

BACKGROUND OF THE INVENTION

Conventional hygienic apparatus, such as bidets, include spray nozzles in a seat or bowl to provide a spray of water to the genital area of a user upon demand. Bidets generally have fixed nozzles located beneath a bowl rim and through a porcelain wall. See U.S. Pat. Nos. 392,461 and 1,990,578.

More recently, toilets or water closets have been adapted with hot and cold water lines distributed within either the toilet bowl rim or seat for providing a flow of water to a nozzle device. See U.S. Pat. Nos. 1,835,497 and 4,242,764. Although these devices permit bidet-type operation within conventional toilets, their exposed mechanical elements are not always sanitary, and often include expensive plumbing fixtures.

The prior art has also addressed the need for additional comfort to the user. The more modern toilet bowl/bidet apparatus includes elaborate nozzle configurations for redirecting the water flow and to enable the user to select a preferred flow direction. See U.S. Pat. Nos. 4,550,454, 3,781,919, 4,691,391 and 4,041,553. Although presenting some additional flexibility and comfort, these improvements are also expensive and often require additional cleaning to keep them in a sanitary condition.

Accordingly, there is a need for a toilet and/or toilet seat having hygienic cleaning apparatus which can be manufactured at low cost, and which require minimal maintenance and cleaning.

SUMMARY OF THE INVENTION

Novel hygienic cleaning apparatus are provided by this invention which include flexible conduit disposed within a cavity of toilet seats and bowl rims. The hygienic cleaning apparatus include a valve-controlled water source for providing an on-demand, water stream. The flexible conduit is designed to be resiliently extendable from a position integral with the toilet seat or rim and preferably includes a nozzle that is disposed to direct water towards the bowl portion of the toilet when not in use. When cleaning is required, the nozzle may be removed from its integral position on the toilet or toilet seat and then directed by the user to clean genital areas, herein referred to as the "point of application". The term "about said point of application" refers to a range within about 10 inches, preferably within about 3 inches from the genital areas.

Accordingly, an inexpensive hygienic cleaning apparatus for toilets is disclosed which avoids scalding users. Additionally, since substantially all of the flexible conduit of the apparatus is preferably coiled within a cavity of the toilet seat or bowl rim, the apparatus improves the sanitary condition of the toilet. The device is virtually maintenance free and very economical.

In further embodiments of this invention, the nozzles connected to the flexible conduit can include magnetic elements for connecting with a matched element on the bowl rim or toilet seat. The flexible conduit can further be helically coiled to permit the apparatus to automatically recoil when the nozzle is released by the user.

It is, therefore, an object of this invention to provide an inexpensive hygienic cleaning apparatus for toilets.

It is still another object of this invention to provide a safe and relatively sanitary hygienic cleaning apparatus which can readily be adapted to a conventional toilet.

With these and other objects in view, which will become apparent to one skilled in the art as the description proceeds, this invention resides in the novel construction, combination, arrangement of parts, and methods substantially as hereinafter described and more particularly defined by the attached claims.

BRIEF DESCRIPTION OF THE DRAWINGS

The accompanying drawings illustrate preferred embodiments of the invention according to the practical application of the principles thereof, and in which.

DESCRIPTION OF THE INVENTION

Figure 1:
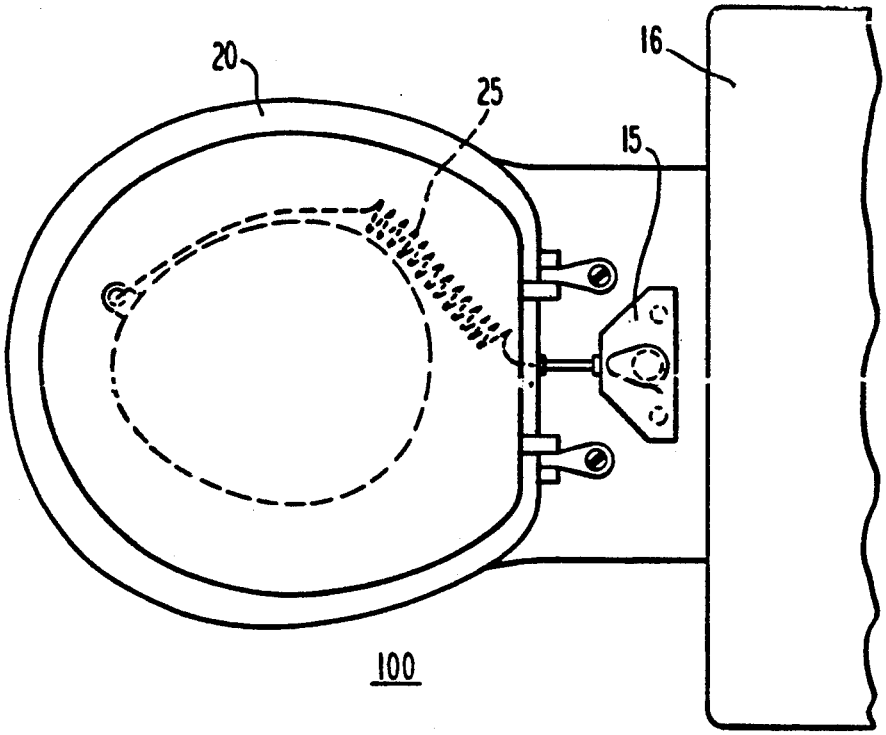
FIG. 1: is a top elevation of a preferred toilet embodiment of this invention illustrating a preferred hygienic cleaning apparatus in phantom.
Figure 2:
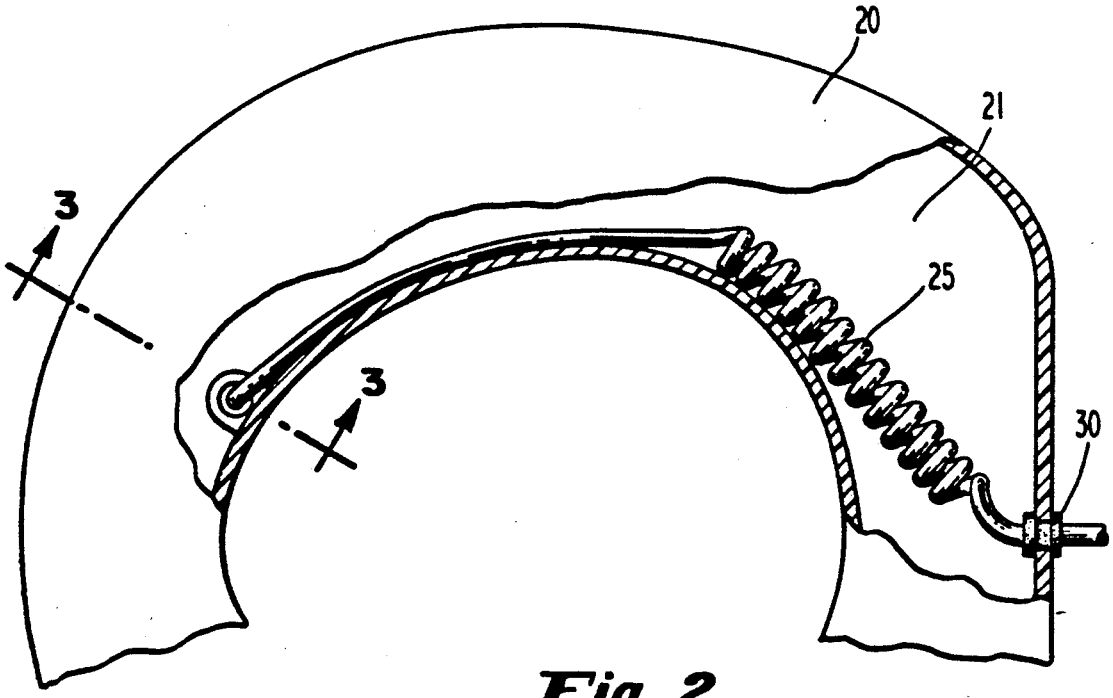
FIG. 2: is a partial top plan view of the toilet embodiment of FIG. 1, illustrating the preferred hygienic cleaning apparatus with a portion of the toilet seat cutaway.

The operable preferred embodiments of this invention will now be described. In one embodiment, a toilet is provided having hygienic cleaning apparatus which includes water source means and valve means for regulating a flow of water. This embodiment also includes flexible conduit means for transferring the flow of water from the valve means to a point of application. The flexible conduit means is resiliently extendable from a position integral with the toilet to the point of application. As used herein, the term "resiliently extendable" refers to the ability of the flexible conduit means to be pulled in tension by the user without substantial deformation. When released, the flexible conduit "bounces back" to substantially the same position it was in prior to handling.

In another embodiment of this invention a toilet is provided which includes hygienic cleaning apparatus comprising a valve-controlled water source means, a flexible conduit, a bowl portion and a seat. This embodiment further includes a compartment for containing a portion of the flexible conduit. The compartment includes a lid means for enabling access to the compartment and flexible conduit by a user.

In still another embodiment of this invention, a toilet seat is provided having hygienic cleaning apparatus. The toilet seat comprises means for attachment to a water source, and flexible conduit means for transferring a flow of water to a point of application. The flexible conduit means of this toilet seat is resiliently extendable from a position integral with the toilet seat to about said point of application. This embodiment can also include a cavity, with or without an access compartment lid arrangement, within the toilet seat for containing a portion of the flexible conduit means. It also may include its own valve means, preferably in-line, on the flexible conduit means. As in the other embodiments, the flexible conduit means can include a helically coiled portion for adding resiliency.

Referring now to the Figures, and particularly to FIGS. 1–4 thereof, preferred toilets having hygienic cleaning apparatus are illustrated. The toilets 100 and 200 include a water closet 16, a toilet seat 20 and a bowl 10. As described, a single lever faucet 15 can be used to supply a mixture of both hot and cold water to the nozzles 40 and 50. However, conventional dual faucets can also be less effectively employed. Preferably, the faucet or faucets are located on a flat section of the toilet located between the toilet seat 20 and the water closet 16. Water is preferably directed to the flexible conduit 25 which is preferably housed within a cavity disposed within the toilet seat 20 as substantially described in FIGS. 1–3, or alternatively disposed within a cavity of the bowl rim 10 as substantially described in FIG. 4.

Alternatively, the toilet seat can be equipped with means for attachment to a water source, e.g. threaded plumbing connection and the like. In such a case, the flexible conduit means could be connected to a water source external to the toilet and its water closet. For instance, it is expected that the toilet seat provided by this invention could be sold independent of the rest of the toilet and readily applied to a convention toilet by persons with minimal plumbing know-how. In such an embodiment, the flexible conduit means can be equipped with a fast disconnect, e.g. for attaching to a sink or bath faucet.

In an important aspect of this invention, the flexible conduit 25 comprises a helically coiled portion disposed preferably within the cavities 21 or 11 to provide the resiliency necessary to enable the flexible conduit to selectively stretch during use. Alternatively, springs or elastic elements can be employed to provide the necessary resiliency to the flexible conduit 25. The conduit itself can be manufactured from conventional plastics, preferably inexpensive thermoplastic materials, e.g., polyethylene. The flexible conduit 25 may also comprise natural or synthetic rubber materials, which alternatively can exhibit resiliency without coiling. Flexible conduit 25 is preferably attached with grommet 30 to the toilet seat 20. A similar arrangement can also be used when the flexible conduit 25 is disposed within a cavity 11 of the bowl portion 10 of the toilet.

Figure 3:
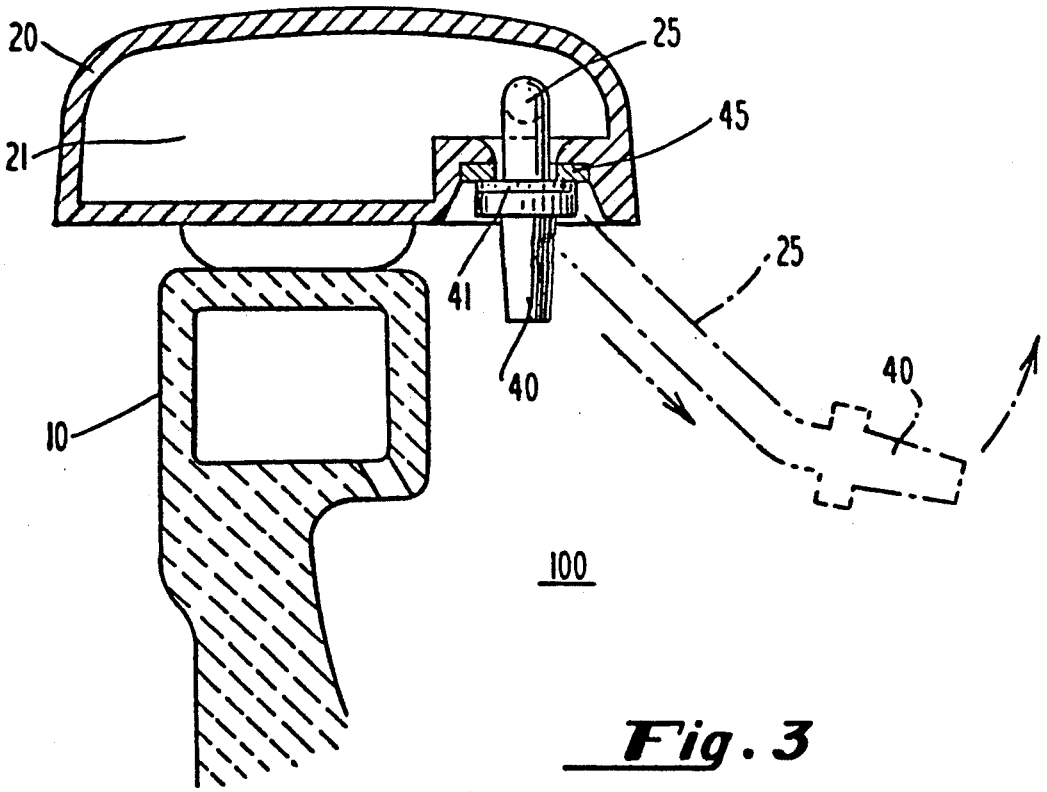
FIG. 3: is a cross-sectional view, taken through line 3—3 of FIG. 2, illustrating a preferred nozzle placement.
Figure 4:
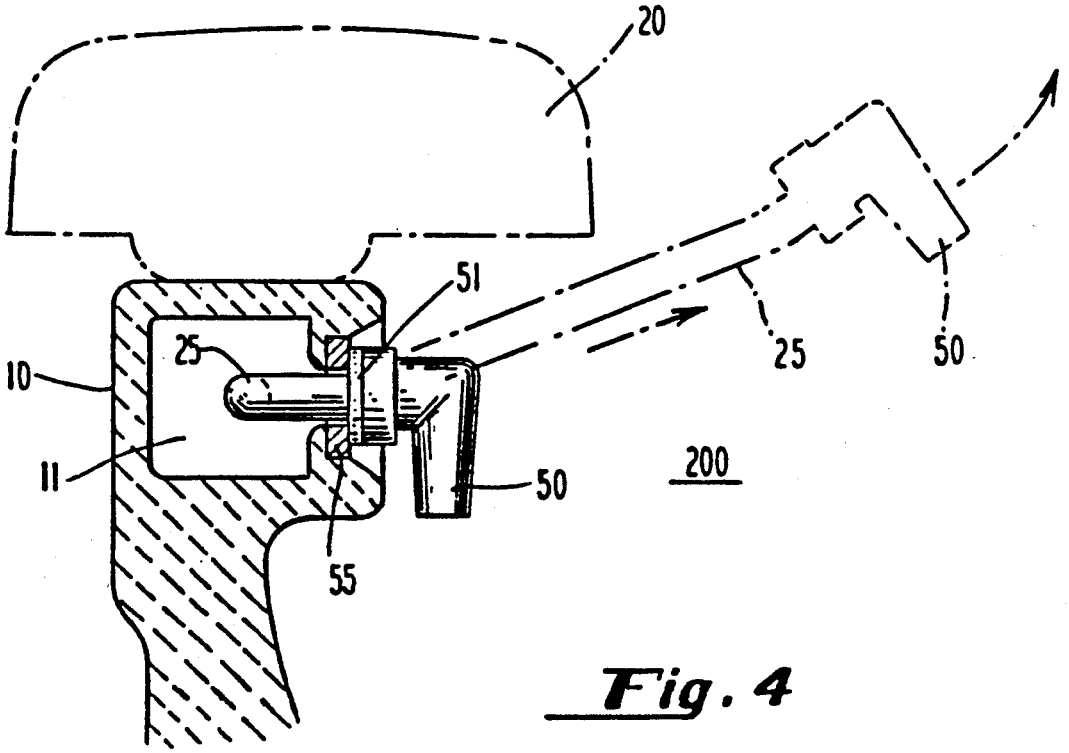
FIG. 4: is an alternative cross-sectional view, illustrating another nozzle placement on the bowl rim.

As illustrated in FIGS. 3 and 4, the flexible conduit 25 is provided with nozzle configurations 40 or 50. In both configurations, however, it is important that the open end of the nozzles 40 and 50 be directed downward, into the bowl, for minimizing any accidental scalding. The nozzles can be equipped with finger operated controls for turning off the water, varying the flow rate and maintaining a spray or stream, e.g. similar to a garden hose.

In another important aspect of this invention, the nozzles 40 and 50 comprise connecting means 41 and 51 adapted to be integrally disposed against a mating surface 45 or 55 of the seat 20 or bowl rim 10. Preferably the connecting means 41 and 51 and the mating surfaces 45 and 5 comprise magnetically-attracting elements to permit the nozzles to remain in place at their integral attachment sites on the seat 20 or bowl rim 10. The nozzles 40 and 50 are preferably located in the front of the toilet and can be offset slightly from the center. It is understood that this location provides ready access to the nozzle by users. Although magnetic elements are disclosed, it is expected that those of ordinary skill in the art will readily adapt other adhering elements to provide an integral connection between the nozzles 40 and 50 and the mating surfaces 45 and 55.

Figure 5:
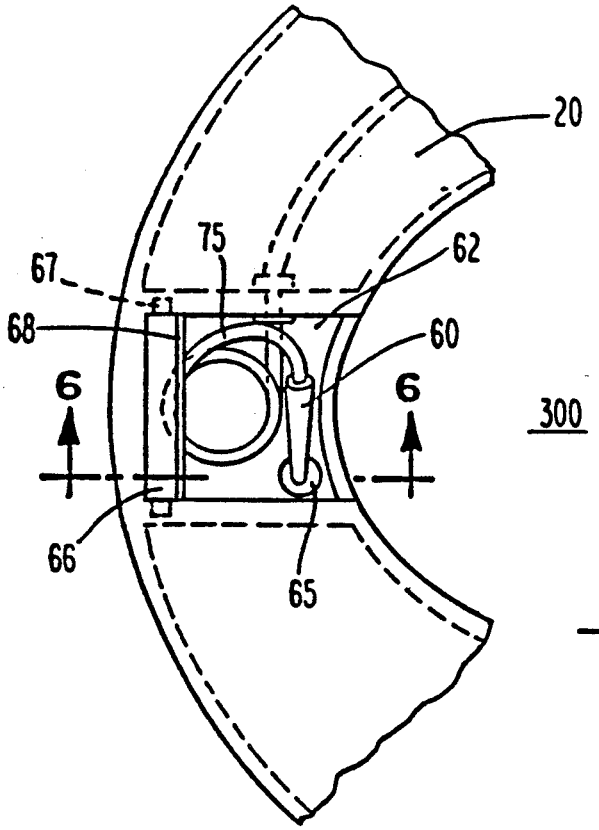
FIG. 5: is a partial top plan view of another toilet embodiment illustrating a nozzle and flexible conduit disposed within a open compartment.
Figure 6:
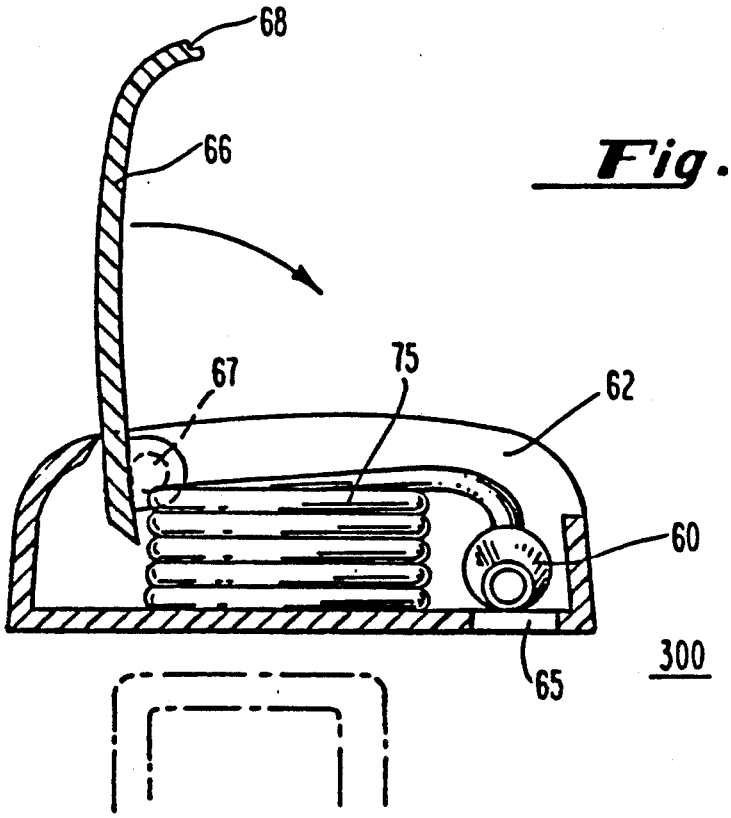
FIG. 6: is an enlarged, cross-sectional view, taken through line 6—6 of FIG. 5, illustrating the operation of a preferred lid construction for the compartment.

Referring now to the embodiment described by FIGS. 5 and 6, a variation of the toilet seat design is provided. The toilet 300 includes water source means, valve means, a bowl portion and a seat as previously illustrated. However, a compartment, preferably an enclosure of approximately 2.5 inches square and about 1 inch deep, is recessed in the front of the toilet seat 20. This embodiment further includes a flexible conduit 75 for transferring the flow of water from the valve means to a point of application. The flexible conduit 75 also includes a resiliently extendable coiled portion. The compartment is designed to contain a portion of the flexible conduit 75 and includes a lid means for enabling access to the compartment by a user.

Toilet embodiment 300 also includes a nozzle 60 disposed on the flexible conduit 75. The compartment can comprise a mating surface which is magnetically, or otherwise, removably attached to the nozzle 60. The bottom of the compartment preferably has a small opening 65 for drainage. The small opening 65 can further include a removable seal. During operation of this embodiment, the user inserts a finger or fingernail in slot 68 which causes door 66 to pivot along hinge 67. This opens the compartment 62 to enable to user to grip the nozzle and remove it from its mating surface 65. The user can then pull out the nozzle to apply water where needed. The flexible conduit 75 can be helically coiled, as in the previous embodiments, to permit resiliency. The lid means, or hinged door 66, preferably is configured to snugly fit into the toilet seat. Ideally, it assumes the contour and configuration of the body-contacting side of the toilet seat 20. This embodiment 300 has the additional benefit of being sealed from contamination when the hinged door 66 is closed.

The operation of the novel hygienic cleaning apparatus will now be described. After toilet use, the valve 15 in the back of the toilet can be opened and adjusted to achieve an acceptable water temperature. (In the alternative embodiment of FIGS. 5 and 6, the compartment is preferably opened and the nozzle released prior to turning on the water.) In all the embodiments 100, 200, and 300, however, it is important that the water be directed downward into the bowl until an acceptable temperature is reached. The genital area can then be washed by applying a steady stream or spray of water from the nozzle, which is easily accessible from the front of the toilet. A partial coiled hose, as previously described, will ensure that the flexible conduit is resilient enough to extend to a usable position. When cleansing is finished, the nozzle can be released. The flexible conduit, having been previously disposed in compression, will retract to its mating surface.

From the foregoing, it can be realized that this invention provides economical and sanitary toilets having improved hygienic cleaning apparatus. The combination of an economical construction and relatively simple structure can provide the service of conventional bidets to any type of toilet. Accordingly, this invention provides all of the benefits of having a bidet, without major renovations, excessive costs or additional space requirements. Although apparatus have been illustrated, this was for the purpose of describing, but not limiting, the invention. Various modifications, which will become apparent to one skilled in the art, are within the scope of this invention described in the attached claims.

What is claimed:

1. A toilet having hygienic cleaning apparatus, comprising:

(a) a water source;

(b) valve means for connecting and regulating a flow of water from said water source; and (c) flexible conduit means for transferring said flow of water from said valve means in a manually selected direction to a point of application, said flexible conduit means resiliently extendable by the direct grasp of a user from a position integral with said toilet to about said point of application, said toilet having a bowl portion having a rim with a substantially enclosed cavity therein disposed to contain a substantial portion of said flexible conduit means, said substantial portion comprising a length of resilient tubing having one end secured within said cavity, said rim having aperture means communicating with said cavity, said substantial portion of said flexible conduit means having an opposite end extending through said aperture means such that a selected amount of said portion is resiliently extendable therefrom only by being directly grasped and manipulated by the user.

2. The toilet of claim 1 wherein said flexible conduit means further comprises a nozzle.

3. The toilet of claim 2 wherein said nozzle comprises connecting means adapted to be integrally disposed against a mating surface of said rim.

4. A toilet having hygienic cleaning apparatus, comprising:

(a) water source;

(b) valve means for regulating a flow of water from said water source; and (c) flexible conduit means for transferring said flow of water from said valve means to a nozzle means which directs said flow to a point of application, said flexible conduit means resiliently extendable from a position integral with said toilet to about said point of application, said toilet having a bowl portion having a rim with a substantially enclosed cavity therein disposed to contain a substantial portion of said flexible conduit means, said rim having aperture means communicating with said cavity, said flexible conduit means extending through said aperture means such that a selected amount of said potion is resiliently extendable therefrom, said nozzle comprising connecting means adapted to be integrally disposed against a mating surface of said rim, said rim and said connecting means comprising magnetically-attracting elements.

5. The toilet of claim 4 wherein said flexible conduit means comprises a helically coiled portion disposed within said cavity of said rim.

* * * * *